United States Patent [19]

Tosaka et al.

[11] 4,203,764

[45] May 20, 1980

[54] POLYESTER OR POLYURETHANE COATED ELECTROSTATIC IMAGE HOLDING MEMBER

[75] Inventors: Umi Tosaka, Tokyo; Hideyo Kondo, Toride; Keiichi Murai, Tokyo; Hitoshi Toma, Kawasaki, all of Japan

[73] Assignee: Canon Kabushiki Kaisha, Tokyo, Japan

[21] Appl. No.: 969,888

[22] Filed: Dec. 15, 1978

Related U.S. Application Data

[63] Continuation of Ser. No. 797,172, May 16, 1977, abandoned.

[30] Foreign Application Priority Data

| | | | |
|---|---|---|---|
| May 17, 1976 | [JP] | Japan | 51-56342 |
| Jun. 15, 1976 | [JP] | Japan | 51-70183 |
| Aug. 23, 1976 | [JP] | Japan | 51-100834 |
| Sep. 16, 1976 | [JP] | Japan | 51-111048 |
| Sep. 30, 1976 | [JP] | Japan | 51-117569 |

[51] Int. Cl.[2] ..... G03G 5/00; G03G 8/00

[52] U.S. Cl. ..... 430/67; 430/533; 430/564

[58] Field of Search ..... 96/1.5, 1 SN, 67, 114, 96/85, 86 R; 355/15

[56] References Cited

U.S. PATENT DOCUMENTS

| | | | |
|---|---|---|---|
| 2,901,349 | 8/1959 | Schaffert et al. | 96/1.5 R |
| 3,629,000 | 12/1971 | Back et al. | 96/1.5 |
| 3,884,690 | 5/1975 | Radler, Jr. | 96/1.5 |
| 3,912,516 | 10/1975 | Recchia | 96/85 |

*Primary Examiner*—John D. Welsh

*Attorney, Agent, or Firm*—Fitzpatrick, Cella, Harper & Scinto

[57] ABSTRACT

An image holding member for holding electrostatic latent images and/or toner images is characterized in that the surface of the image holding member has a surface layer formed by a coating, said surface layer essentially consisting of at least one of substances A and B wherein the substance A is a linear polyester resin soluble in organic solvents and the substance B is a copolymerization product of a linear isocyanate of the formula:

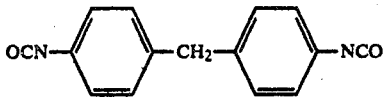

and a polyol of the formula: $HO-(CH_2)_n-OH$ wherein n is a positive integer.

6 Claims, No Drawings

POLYESTER OR POLYURETHANE COATED ELECTROSTATIC IMAGE HOLDING MEMBER

This is a continuation of application Ser. No. 797,172 filed May 16, 1977.

BACKGROUND OF THE INVENTION

1. Field of the Invention

The present invention relates to an image holding (or carrying member for holding (or carrying) electrostatic latent images and/or toner images. The image holding member according to the invention is intended to be used principally in electrophotography.

2. Description of the Prior Art

Hitherto as an image holding member for use in electrophotography there have been known and used two types of image holding members, one of which is an electrophotographic photosensitive member and the other consists of a group of image holding members other than the electrophotographic photosensitive member. The first mentioned electrophotographic photosensitive member has a great variety of arrangement and may be designed so as to meet the characteristics requirements as then desired and to well suit to the electrophotographic process as then employed.

A typical example of electrophotographic photosensitive member in use widely is designed to provide its surface with an insulating surface layer. This insulating surface layer is provided for the purpose of protecting the photoconductive layer as well as improving the mechanical strength and the dark decaying property of the member. Also, the provision of an insulating surface layer is necessary to make the member adoptable in a certain particular electrophotographic process. Various representative examples of the photosensitive member provided with such an insulating surface layer and the electrophotographic process in which such a photosensitive member is used, are disclosed, for example, in U.S. Pat. No. 2,860,048 and Japanese Patent Publication Nos. 16429/1966, 15446/1963, 3713/1971, 23910/1967, 19747/1967 and 4121/1961.

When the electrophotographic photosensitive member is subjected to a specific electrophotographic process, an electrostatic latent image is formed thereon which is visualized by developing with a toner.

As to another image holding members, some representative examples thereof will be described hereinafter.

An electrostatic latent image formed on the electrophotographic photosensitive member having a photoconductive layer by a certain electrophotographic process is usually developed with a toner and then the toner image thus formed is transferred to a suitable recording member such as a sheet of paper. According to other electrophotographic process as disclosed, for example, in Japanese Patent Publication Nos. 7115/1957, 8204/1957 and 1559/1968, the electrostatic latent image formed on an electrophotographic photosensitive member is at first transferred to an electrostatic latent image holding member on which the transferred latent image is developed with a toner and thereafter the toner image is transferred to a recording member. This modified process contributes to the improvement of repeating usability of the electrophotographic photosensitive member.

Further modifications of the electrophotographic process are disclosed, for example, in Japanese Patent Publication Nos. 30320/1970 and 5063/1973 and Japanese Patent Application laid open No. 341/1976. These modifications are used to form on an electrostatic latent image holding member an electrostatic image corresponding to the electrostatic image formed on an electrophotographic photosensitive member. In the modifications, there is used an electrophotographic photosensitive member in the form of a screen having a plurality number of fine openings on which an electrostatic latent image is formed by a specific electrophotographic process. Through the electrostatic latent image formed on the electrophotographic photosensitive member, a corona charging treatment is conducted for the electrostatic latent image holding member so as to form thereon an electrostatic latent image by modulating the ion stream of corona. The electrostatic latent image formed on the image holding member is then developed with a toner and the developed image is transferred to a recording member to obtain the final image.

Furthermore there is known such a process according to which the toner image formed on the electrophotographic photosensitive member or the electrostatic latent image holding member is not directly transferred to the recording member, but it is transferred at first to a toner image holding member and then to a recording member on which the toner image transferred from the toner image holding member is fixed. This process is particularly effective for forming a color image or for carrying out a high speed copying. As the recording member, high flexible material such as sheet of paper and film is generally used. Therefore, it is somewhat difficult to transfer a tricolor image to such a recording material while maintaining accurate alignment (or registration) of the color components of the image. The process in which a toner image holding member that may be made of a hardly deformable material is used, has an advantage in view of accurate alignment of the color image components. Namely, a well aligned color image can be formed by at first transferring the color components of a tricolor image to a hardly deformable toner image holding member and thereafter transferring the toner image on the member to such a recording member all at once. Also, by using the process in which a toner image is transferred to a recording member through a toner image holding member, a substantial speed up of copying operation may be attained.

As will be seen from the foregoing, it is very important for an image holding member, which may be an electrophotographic photosensitive member or other member having no photoconductive layer used for holding an electrostatic latent image or toner image, to have a particular electric characteristic suitable to the electrophotographic process then used. Besides, durability and cleaning property are other important properties which such an image holding member should have. A high durability is required when the image holding member must be repeatedly used. The cleaning property is indispensable for determining the easiness of the removal of any residual toner adhered to the surface of the image holding member. To obtain a clear and sharp image and also to prevent the associated cleaning means from being damaged, the cleaning property is of critical importance. For the reason, various attempts have been made to improve the durability and cleaning property of the image holding member. The provision of a surface layer having excellent durability is one typical solution of the problem. Examples of such a surface layer applied onto a photoconductive layer, insulating layer or electric conductive layer include thin layers of vinyl cellulose, ethyl cellulose, acrylic urethane, polyparaxylylene, aluminum oxide and titanium oxide. Also, it is known to overlay a film sheet of polyethylene terephthalate, polyethylene, polypropylene and polystyrene on the photoconductive layer by using a suitable bonding agent or to vapour-deposit an inorganic material such as mica onto the layer. Among them, teflon, polyethylene, polyethylene terephthalate and vinylidene fluoride resins and the like are preferable ones useful for forming a surface layer having excellent lubrication property, durability and cleaning property.

However all these materials are in the form of film sheet and therefore they necessitate a high standard bonding technique by which the material in the form of film sheet can be adhered to a photoconductive layer, insulating layer or electric conductive layer with a suitable bonding agent. This brings forth only a relatively low efficiency. Furthermore, it is almost impossible to form a seamless surface layer on an image holding member in the shape of drum. With acrylic urethane or epoxy resin it may be possible to form a surface layer by coating techniques. But, the surface layer thus formed lacks adequate lubrication property, durability and cleaning property.

Another disadvantage of an image holding member provided with a conventional surface layer is an insufficient moisture resisting property. When the image holding member is used for a long time in the atmosphere of high humidity, the characteristics of the member is adversely affected and therefore the quality of image formed thereon is remarkedly deteriorated.

SUMMARY OF THE INVENTION

Accordingly it is the primary object of the present invention to provide an improved image holding member with excellent surface lubrication property, durability and cleaning property and having thereon a surface layer formed as a coating film.

It is another object of the present invention to provide an improved image holding member having a good moisture resisting property.

It is another object of the present invention to provide an improved image holding member with excellent durability, cleaning property and good moisture resisting property, which is easy to manufacture.

A further object of the present invention is to provide an improved image holding member which allows the formation of clear and sharp images.

According to the present invention, there is provided an image holding member for holdng electrostatic image and/or toner image characterized in that the surface of the image holding member has a surface layer formed by coating, said surface layer essentially consisting of at least one of substances A and B wherein the substance A represents a linear polyester soluble in organic solvent and the substance B represents a polymerization product of a linear isocyanate compound of the formula:

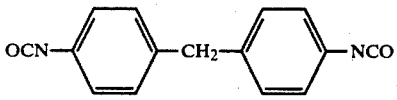

and a polyol compound of the formula: $HO—(CH_2)_n—OH$ wherein n is a positive integer, the polymerization product has a repeated unit of the formula:

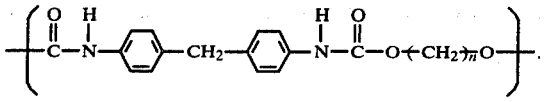

The above and other related objects and features of the invention will appear more fully hereinafter from a reading of the following description of the preferred embodiments of the invention.

DESCRIPTION OF THE PREFERRED EMBODIMENTS

The substances A and B used in the invention have various remarkable advantages and good properties. They are not only excellent in lubrication property and moisture resisting property but also good insulating materials. The coating film layer formed of them has a high hardness and a good adhesion property to a photoconductive layer or insulating layer. Also they exhibit a good transparency. Since a surface layer can be formed on any image holding member by coating process, it is also possible to form a seamless surface layer on an image holding member in the shape of drum.

Owing to the excellent properties of the substances A and B, the image holding member according to the present invention exhibits a very small surface friction resistance and, therefore, the durability of the member is also excellent. It is allowed to prevent a cleaning means from being damaged. The moisture resisting property of the image holding member can be remarkedly improved.

The substance A, i.e. a linear polyester resin used in the present invention is prepared by polycondensation (ester polymerization) of at least one kind of organic dibasic acid compound and at least one kind of diol compound, and it is a polymer soluble in a usual organic solvent such as acetone, methyl ethyl ketone, dimethyl ketone, diethyl ether, dimethyl ester, chloroform, dichloroethane and the like. The polyester resin used in the present invention must be linear for the purpose of exhibiting solubility in a usual organic solvent. That is, the polyester resin used in the present invention is a polymer having no side chain which makes the polyester insoluble in a usual organic solvent. Further, in polyester polymerization, dibasic acid compound and diol compound are caused to react with each other in mole ratio of 1:1. Examples of the organic dibasic acid compound are dicarboxylic acid and anhydride thereof such as adipic acid, phthalic acid, phthalic anhydride, maleic acid, maleic anhydride, succinic acid, succinic anhydride and sebacic acid. Examples of diol compound include ethylene glycol, hexamethylenediol-1,6, bisphenol-A, butane diol-1,4, pentadiol-1,5, diethylene glycol and propylene glycol-1,3.

The organic solvent soluble type of linear polyesters used in the invention may be those which are commercially available or those particularly prepared for this purpose. The kind and sort of linear polyester to be employed may vary in accordance with the kind and sort of the photosensitive member then used. In particular, the linear polyesters having a glass transition point of 40° C. or above the preferably used.

The linear polyester may be represented as a polymer having a structural unit: $\text{-}\!\!\left(\text{OOC-R-COO-R'}\right)\!\!\text{-}$ when the dibasic acid compound is indicated by the formula:

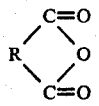

and the diol compound is indicated by HO—R'—OH. In the formula, the R and R' is organic groups mainly composed of carbon and hydrogen atoms, and at least two kinds of R and/or R' may be present in the structural unit.

The organic solvent soluble type of linear polyester resin is a polyester having a relatively low molecular weight which is generally in the range of 5,000 to 50,000. The polyester resins preferably used in the invention have the molecular weight in the range of 10,000–40,000.

When a surface layer containing, as essential component, a linear polyester resin should be applied to an image holding member, the surface layer may be generally formed by coating a solution of the resin in a suitable organic solvent onto an insulating layer, electric conductive layer or photoconductive layer of the member.

When a surface layer containing essentially a linear isocyanate compound and a polyol compound should be applied, a solution containing both of the compounds may be coated onto an insulating layer, electric conductive layer or photoconductive layer of the subject member. After coating, the both compounds in the coating layer are subjected to a polymerizing treatment to polymerize them through urethane bonds into a polymer. That is, isocyanate groups: —N=C=O in the both ends of the linear isocyanate compound and hydroxy groups: HO— in the both ends of the polyol compound react with each other to form a urethane bond:

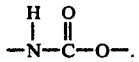

In such a manner, the isocyanate compound and the polyol compound are subjected to addition polymerization to form a polymer. To carry out the necessary polymerizing treatment, heat, light, electron beam and the like may be used as desired.

The ratio of the polyol compound to the linear isocyanate compound may be selected at discretion. But, generally speaking, the ratio of 90–98 parts by weight of the polyol compound to 100 parts by weight of the linear isocyanate compound is preferable. As the polyol compound, those which are soluble in solvent are used. The integer "n" in the above given formula is preferably 2–20. For example, ethylene glyco (n=2), butanediol (n=4) hexamethylenediol (n=6) and dodecanediol-1,12 (n=12).

Since both the compounds, polyol and linear isocyanate are soluble in organic solvent, a surface layer can be formed in the manner of coating. If desired, the linear isocyanate and the polyol may be preliminarily polymerized to some extent before coating. Here the expression "to some extent" means that the compounds are polymerized to such an extent that the preliminarily and partially polymerized product may be still remained easily soluble in the organic solvent then used.

A surface layer, essentially containing both of the substances A and B may be formed, for example, by preparing a solution containing a liner polyester resin, a linear isocyanate compound and a polyol compound, coating the solution onto an insulating layer, photoconductive layer or electric conductive layer of the subject member and drying (or hardening) the coating layer.

The polymerization product, which is produced from the linear isocyanate compound and the polyol compound and forms a surface layer, has a molecular weight ranging from 10,000 to 60,000 and in particular the range of 15,000–30,000 is preferable.

The thickness of the surface layer may vary in accordance with the particular characteristics required for it.In case that the principal purpose of the provision of such a surface layer is to protect the image holding member as well as to improve its durability and dark decaying property, the thickness may be relatively small. On the contrary, when the image holding member is expected to be for use in a particular electrophotographic process, a relatively large thickness may be selected for the surface layer. In general, the thickness of a surface layer is in the range of 0.1 to 100μ and more particularly 0.1–50μ.

If desired, some other additional component(s) may be added to the essential component of the surface layer. Examples of such an additional component include various isocyanates as will be particularly mentioned later in the Examples, silane coupling agent, fatty acid amides, fatty acid metal salts and wax. Silane coupling agent is able to attribute to the improvement of adhesion and hardness of the surface layer according to the invention. Preferable silane coupling agents are those which have vinyl-, epoxy-, methoxy-or ethoxy group. Such a silane coupling agent can react with polar groups such as OH, COOH and the like existing in the moleculars of the used resin surrounding the agent so that the bond between the coupling agent and the resin may be formed.

Typical examples of silane coupling agent are given below:

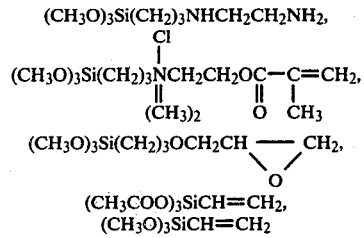

Fatty acid amides or fatty acid metal salts may attribute to the improvement of image density. Examples of such additive are amides and metal salts of stearic acid and oleic acid.

By the addition of wax, a further improvement of moisture resisting property of the surface layer is attainable. Any commonly used wax including ethylene wax and paraffin wax may be used.

Also, substance A and/or substance B used in forming a surface layer may further contain other additional resins. Examples of other resin suitable for additives are polyethylene, polyester, polypropylene, polystyrene, polyvinyl chloride, polyvinyl acetate, acrylic resin, polycarbonate, silicone resin, fluorine-contained resin, epoxy resin and the like. These resins are organic insulating materials. Other examples of usable resin as additives are setting (or curing) resins such as urethane resin, acrylic resin and acrylic urethane resin (that is a resin having both of urethane bond and acrylic double bond and obtainable by the reaction among acrylic monomer, isocyanate compound and polyol compound), which serve to further improve the hardness of the surface layer according to the invention. The content of these additive resins is preferably in the range of 1–25 wt %. Furthermore, by adding a silicone resin to the surface layer, a further improved cleaning property is obtained.

In case that the image holding member according to the invention is an electrophotographic photosensitive member, it is generally manufactured as a laminate in which the photoconductive layer is sandwiched in between a support and a surface layer. The support may be made from suitable material such as a metallic sheet of stainless steel, copper, aluminum or tin, paper, sheet, a resin film and the like. The support is not always necessary. It may be omitted if desired.

The photoconductive layer may be formed by vapour-depositing in vacuum a suitable inorganic photosensitive material such as a simple substance of S, Se or PbO, or alloys and intermetallic compounds containing S, Se, Te, As, Sb and/or Pb. When the sputtering method is employed to form the photoconductive layer, it may be formed by making a photoconductive substance with high melting point such as ZnO, CdS, CdSe and $TiO_2$ adhere to a support. If a coating method is employed to form the photoconductive layer, an organic photoconductive material such as polyvinyl carbazole, anthracene and phthalocyanine including those sensitized by adding pigment or Lewis acid and their mixture with an insulating binder may be used. A mixture of an inorganic photoconductive substance such as ZnO, CdS, $TiO_2$ and PbO with an insulating binder also may be used. As the insulating binder, various resins may be used. The thickness of photoconductive layer may be varied in accordance with the type and characteristics of the photoconductive substance then used. Generally speaking, the range of 5–100μ and in particular 10–50μ is preferable.

Between the surface layer and the photoconductive layer there may be interposed an additional layer containing neither substance A nor B.

In case that the image holding members of the invention are those which comprise no photoconductive layer, one typical structure of the members comprises a support and a surface layer formed thereon. Another structure comprises a support, an insulating layer made of other material and a surface layer formed on the insulating layer by coating.

Hereinafter the invention will be more fully described by way of examples. "Five nine" means 99.999%.

EXAMPLE 1

200g of a high purity (five nine) Se was weighed and placed on an evaporating dish. With the high purity Se, a vapour depositing was carried out for 35 minutes under the conditions of 300° C. of evaporating source temperature, 66°–68° C. of substrate (a drum made from aluminum) temperature and $1\times10^{-5}$ torr of vacuum in the system. Thus, two photosensitive drums were made each of which had a photoconductive layer of film 60μ thick.

To one of the two photoconductive layers thus formed, a surface layer was applied. To form the surface layer on it, the one photosensitive layer was dipped into an immersion liquid bath containing a photosetting (photo curing) type of acrylic urethane.resin (trade name: SONNE, manufactured by Kansai Paint Co. Ltd.). The immersion bath was prepared by diluting the resin with ethanol to a viscosity of 100 cps.

The layer was drawn up from the immersion bath in the direction normal to the liquid level and along the generating line of the drum. Thereafter, it was exposed to the rays of a 4 KW mercury lamp for six minutes to effect photosetting. A surface layer 0.8μ thick was obtained which is hereinafter referred to as Sample (A).

Another photoconductive layer was dipped into an immersion liquid bath prepared by diluting a mixture (96:4) of a linear polyester (trade name: VYLON 200, by Toyobo Co., Ltd.; starting monomers: ethylene glycol, butanediol and terephthalic acid; m.w.: about 15,000–20,000) and an isocyanate (COLONATE L, by Nippon Polyurethane Co., Ltd.) of the formula:

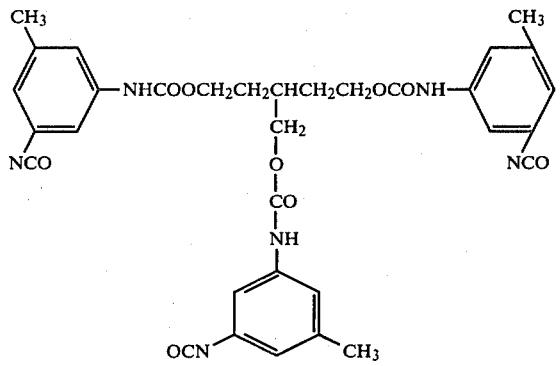

with methyl ethyl ketone to a viscosity of 100 cps. Thereafter it was drawn up in the same direction as described above and subjected to a thermosetting treatment by heating it at 70° C. for 20 minutes. In this manner, a surface layer 0.9μ thick was formed, which is hereinafter referred to as Sample (B).

With each of the Samples (A) and (B), a durability test was carried out in the following manner:

The sample was charged by a primary DC charging with positive polarity so that the surface voltage reached the level of 900 V and then imagewise-exposed at an exposure value of 25 lux.sec. Thereafter it was developed with dry developer for magnet brush charged with negative polarity and cleaned with a cleaning blade made of urethane rubber. The cleaning blade made of urethane rubber. The cleaning blade had a hardness of 70, a blade angle of 30° rotative to the drum and a blade pressure of 1.0 Kg (load).

During the cleaning, Sample (A) generated a tremendous rubbing noise due to the friction between the cleaning blade and the surface layer. After fifty (50) revolutions of the drum, a remarkable wear was observed at the edge portion of the blade and also a distinct damage was found on the surface layer. At the most heavily damaged portion, the damage reached even the photoconductive layer surface.

In contrast with Sample (A), the drum of Sample (B) continued rotating smoothly with a torque under 0.5 Kg and the image on it could maintain its good quality. Even after forty thousand (40,000) revolutions of the drum, there were scarcely observed breaking at the edge portion of the blade and cleaning damage on the surface layer.

In the following examples, when the term "linear polyester" is used without any further specification, it denotes that of VYLON 200 (trade name).

EXAMPLE 2

200g of a high purity (five nine) Se - Te (15wt. %) alloy was weighed and placed on an evaporating dish. With this alloy, vapour depositing was carried out for forty minutes under the conditions of 320° C. of evaporating source temperature, 70° C. of substrate (aluminum drum plated with Ni) and $1\times10^{-5}$ torr of vacuum in the system. Thus, two photosensitive drum were made each of which had a photoconductive layer of film 65μ thick.

To one of the two photoconductive layers thus formed, a surface layer was applied in the following manner. An immersion bath was prepared by diluting a photosetting type of unsaturated polyester resin (that is a non-linear polyester resin; starting monomers: ethylene glycol, glycerin, adipic acid and maleic anhydride; m.w.: about 3,000; trade name: "UV-CM-103", manufactured by Cashew Co., Ltd.) with methyl ethyl ketone to a viscosity of 90 cps. The one drum was dipped into the immersion liquid bath thus prepared. Thereafter, in the same manner as in Example 1, it was drawn up from the bath and subjected to a photosetting treatment by irradiation of a 4 KW mercury lamp for six minutes. The above described operation was repeated three times so that a surface layer 30μ thick was formed. This sample is hereinafter referred to as Sample (C).

To the other photoconductive layer, at first a layer 20μ thick was applied by carrying out coating twice in the same manner as that for Sample (C). Then, a surface layer of 10 μ thick was overlaid on the 20 μ thick layer. To form the surface layer, an immersion bath was used which was prepared by diluting a mixture of a linear polyester and an isocyanate (trade name: "HMDI", by Nippon Polyurethane Co., Ltd.) (weight ratio of 95 to 5) with methyl ethyl ketone as to have the viscosity of 90 cps. Dipping in the immersion bath and drawing up from it were effected in the same manner as in Example 1. Hardening was effected by heating it at 70° C. for thirty minutes. This sample is referred to as Sample ($D_1$).

Each of Samples (C) and ($D_1$) was passed through an electrophotographic process comprising the steps of a primary DC charging with negative polarity, a secondary AC discharging simultaneous with imagewise exposure and a whole surface exposure so as to form an electrostatic latent image thereon. After developing the latent image with dry developer for magnet brush charged with positive polarity, the same durability test as that in Example 1 was carried out for Samples (C) and ($D_1$). The results of the test were as follows:

Sample (C) generated a tremendous rubbing noise during the test and after sixty (60) revolutions of the drum, the edge portion of the drum was worn out to tear.

Sample ($D_1$) continued rotating smoothly and maintained the good cleaning feasibility. Even after 30,000 revolutions of the drum, there was observed no change from the original state at the edge portion of the drum and on the surface layer.

Further samples, Sample $D_2$–$D_{11}$ were prepared by substituting the following materials for the linear polyester and the isocyanate used for Sample $D_1$ in this example and tested in the same manner as the above. All of the photosensitive drums of Samples $D_2$ through $D_{11}$ exhibited an excellent durability similar to that of Sample $D_1$. Even after 30,000 revolutions of the drums, neither deterioration of image quality nor reduction in cleaning feasibility was observed. Photosensitive drums $D_2$–$D_6$ were prepared by using a mixture of linear polyesters and isocyanate (hexamethylene diisocyanate of $\text{-(OCN—CH}_2\text{-)}_6$ NCO trade name: HMDI) (95:5) as shown in $D_2$–$D_6$ below.

$D_2$: adipic acid-ethylene glycol copolymerization polyester (Mole ratio: 1:1; molecular weight: about 25,000) of the formula:

$$\text{-(OOC-(CH}_2\text{)}_4\text{COO-(CH}_2\text{)}_2\text{)}_l\text{-}$$

$D_3$: terephthalic acid-ethylene glycol copolymerization polyester (Mole ratio: 1:1; m.w.: about 38,000) of the formula:

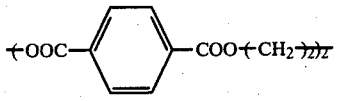

$D_4$: terephthalic acid-adipic acid-ethylene glycol terpolymerization polyester (Mole ratio: 1:1:2; m.w.: about 20,000) of the formula:

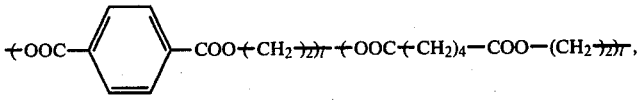

$D_5$: terephthalic acid-bisphenol A copolymerization polyester (Mole ratio: 1:1; m.w.: about 7,500) of the formula:

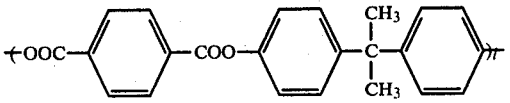

$D_6$: terephthalic acid-adipic acid-bisphenol A terpolymerization polyester (Mole ratio: 1:1:2; m.w.: about 30,000) of the formula:

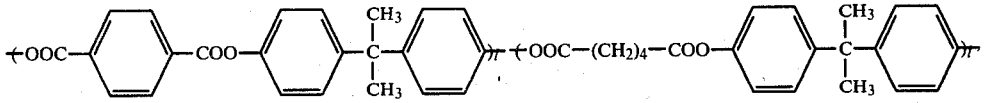

In the above formulas, l and l' are positive integers.

$D_7$: a mixture (95:5, by weight) of a linear polyester (starting monomers: ethylene glycol, hexanediol and terephthalic acid; m.w.: about 20,000, trade name: 49001, by Du Pont) and a photosetting type of acylic urethane resin (manufactured by Kansai Paint Co., Ltd.) (setting condition: irradiation of ultraviolet rays with mercury lamp for six minutes)

$D_8$: a mixture (90:5:5, by weight) of a linear polyester resin (having acryl group at the terminal of the chain; starting monomers: adipic acid and polyethylene glycol; m.w.: about 6,000, by Kansai Paint Co., Ltd.), a photosetting type of acrylic urethane resin and a silicone oil (trade name: SH 157, by TORE Silicone Co., Ltd.) (setting condition: irradiation of ultraviolet rays with mercury lamp for six minutes)

| | |
|---|---|
| $D_9$: linear polyester | 94 parts |
| thermosetting acrylic urethane resin | |
| (trade name: RETAN, supplied by Kansai Paint Co.) | 6 parts |
| setting condition = 70° C., 15 min. | |
| $D_{10}$: linear polyester | 93 parts |
| urethane resin | |
| (trade name: KANSAI URETHANE 500, supplied by Kansai Paint Co., Ltd.) | 6 parts |
| silicone oil (trade name: SH 157) | 1 part |
| setting condition = 80° C., 15 min. | |
| $D_{11}$: linear polyester | 95 parts |
| acrylic resin | 5 parts |
| (trade name: ACDECK A-810, supplied by Japan Reichhold Chemicals Co., Ltd.) | |
| setting condition = 80° C., 15 min. | |

EXAMPLE 3

200g of a high purity (five nine) Se was weighed and placed on an evaporating dish. Using it, vapour depositing was carried out for thirty five minutes under the conditions of 300° C. of evaporating source temperature, 67° C. of substrate (aluminum cylinder) and $1\times10^{-5}$ torr of vacuum in the system. Thus, two photoconductive layers were made each of which has the film thickness of 60μ.

One of the two photoconductive layers was dipped into an immersion liquid bath which was prepared by diluting a photosetting type of acrylic urethane resin (trade name: SONNE, by Kansai Paint Co., Ltd.) with methyl ethyl ketone to a viscosity of 90 cps. After drawing it up from the bath at the rate of 30 mm/min., a setting treatment was carried out by irradiating it for five minutes with a 4 KW mercury lamp so that an insulating layer 10μ thick was formed. The same coating operation was repeated three times so that a surface layer having the thickness of 30 μ in total was formed. This sample is referred to as Sample $D_{12}$.

For the other photoconductive layer, an immersion liquid bath was prepared by diluting a mixture (1.2:1) of a linear isocyanate of the formula:

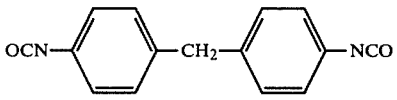

and a hexamethylene diol of the formula: $HO—(CH_2)_6—OH$ with methyl ethyl ketone to a viscosity of 90 cps. The photoconductive layer was dipped in the immersion liquid bath and drawn up from it at the rate of 30 mm/min. Then, a thermosetting treatment was carried out at 55° C. for twenty minutes so that a layer 10μ thick was formed. This procedure of immersion coating was repeated three times so as to finally form a surface layer 30μ thick. This sample is referred to as Sample $D_{13}$.

Each of Samples $D_{12}$ and $D_{13}$ was tested to evaluate the lubrication property, image forming property and durability thereof. To this end, each the Samples $D_{12}$ and $D_{13}$ was passed through an electrophotographic process comprising the steps of a primary DC charging with negative polarity, a secondary AC discharging simultaneous with imagewise exposure, a whole surface exposure, a development with a dry positive toner and cleaning. Cleaning was effected with a urethane cleaning blade having the hardness of 70 (blade angle relative to the cylinder was 30° and the blade load was 2.0 Kg).

During the test, Sample $D_{12}$ generated a loud sliding noise due to the friction between the blade and the surface layer and its coefficient of friction was found to be 2.60. After fifty (50) revolutions of the drum, a remarkable wear of the edge portion of the blade as well as a distinct damage on the surface layer were observed, and at the most heavily damaged portion, the surface layer was found to be just before peeling off.

Sample $D_{13}$ continued rotating smoothly and its coefficient of friction was measured to be 1.05. The quality of image was kept good. Even after forty thousand (40,000) revolutions of the drum, there was observed essentially neither wearing off at the edge portion of the blade nor cleaning damage on the surface layer.

EXAMPLE 4

200g of a high purity (five nine) Se-Te (10 wt. %) alloy was weighed and placed on an evaporating dish. Using it, vapour depositing was carried out for 40 minutes under the conditions of 320° C. of evaporating source temperature, 70° C. of substrate (aluminum cylinder) and $1\times10^{-5}$ torr of vacuum in the system. Thus, two photoconductive layers were made each of which has the film thickness of 65 μ.

One of the two photoconductive layers was dipped into an immersion liquid bath which was prepared by diluting a photosetting type of unsaturated polyester resin with methyl ethyl ketone to a viscosity of 90 cps. After drawing it up from the bath at the rate of 30 mm/min., a setting treatment was carried out by irradiating it for five minutes with a 4 KW mercury lamp. The same dipping coating operation was repeated three times so that a surface layer having the thickness of 30μ in total was formed. This sample is referred to as Sample $D_{14}$.

For the other photoconductive layer, an immersion liquid bath was prepared by diluting a mixture (2:1) of a linear isocyanate of the formula:

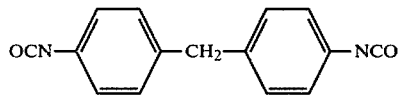

and ethylene glycol of the formula: $HO—(CH_2—CH_2)—OH$ with methyl ethyl ketone to a viscosity of 90 cps. The photoconductive layer was dipped in the immersion liquid bath and drawn up from it at the rate of 30mm/min. Then, a thermosetting treatment was carried out at 55° c. for thirty minutes so that a layer of 10μthick was formed. This procedure of immersion coating as repeated three times so as to finally form a surface layer 30μ0 thick. This sample is referred to as Sample $D_{15}$.

Each of Samples $D_{14}$ and $D_{15}$ was tested in the same manner as that of Example 3.

During the test, Sample $D_{14}$ generated a loud sliding noise due to the friction between the blade and the surface layer and its coefficient of friction was found to be 2.83. After forty (40) revolutions of the drum, a remarkable wear of the edge portion of the blade as well as a distinct damage on the surface layer were observed.

Sample $D_{15}$ continued rotating smoothly and its coefficient of friction was measured to be 1.15. The quality of image was good. Even after 35,000 revolutions of the drum, there was observed essentially neither wearing off at the edge portion of the blade nor cleaning damage on the surface layer.

EXAMPLE 5

200g of a high purity (five nine) Se-As (1.0 wt%) alloy was weighed and placed on an evaporating dish. Using the alloy, vapour-depositing was carried out for 40 minutes under the conditions of 315° C. of evaporating source temperature, 67° C. of substrate (aluminum cylinder) temperature and $1\times10^{-5}$ torr of vacuum in the system so that a photoconductive layer 65μ thick was formed.

The photoconductive layer thus formed was dipped into a liquid bath prepared by diluting a thermosetting acrylic resin (trade name: PULSLAC No. 2000, by Chugoku Marine Paints Co., Ltd.) with methyl ethyl ketone to a viscosity of 90 cps. After drawing up from the bath at the rate of 30 mm/min., a thermosetting treatment was carried out at 50° C. for thirty minutes. This dipping coating procedure was repeated twice so as to finally produce layer 20μ thick.

Onto the 20μ thick layer, a surface layer 10μ thick was overlaid. The surface layer was applied in the following manner:

A mixture (2:0.8:0.1) of

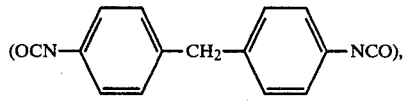

[HO—$(CH_2)_{12}$—OH] and a silicone oil modified by stearic alcohol was diluted with tetrahydrofuran to a viscosity of 90 cps. The sample described above was dipped in the liquid bath thus prepared and drawn up from it at the rate of 30 mm/min. Setting was effected by heating it at 55° C. for thirty minutes to form a layer of 10μ thick.

The photosensitive drum thus manufactured was tested in the same manner as in Example 3.

The drum continued rotating very smoothly, and it was found that its image forming property and cleaning feasibility were good. Even after 50,000 revolutions of the drum, there was not observed any change in operations from its original state. The edge portion of the cleaning blade and the surface layer were maintained unchanged and undamaged.

EXAMPLE 6

Onto an aluminum drum, there was coated a layer 50μ thick of CdS dispersion according to the immersion coating method and heated for fifteen minutes at 80° C.

Thereafter, a coating 12μ thick of photosetting acrylic urethane resin (trade name: SONNE, by Kansai Paint Co., Ltd.) was overlaid on the layer. After heating for fifteen minutes at 70° C., it was subjected to the irradiation of an 8 KW mercury lamp for ninety sec.

Lastly a surface layer was overlaid on it by using an immersion bath which was prepared by diluting a mixture (96:4) of a linear polyester and an isocyanate i.e. ethylene diphenyl isocyanate with methyl ethyl ketone to a viscosity of 90 cps. After drawing up from the immersion bath in the same manner as in Example 1, the coated layer was hardened by heating it at 70° C. for thirty minutes. Thus, a surface layer 12μ thick was formed.

The photosensitive drum obtained in this manner was tested according to the same testing procedure as that in Example 2. During the test, the drum continued rotating smoothly and it was found that the image forming property and cleaning feasibility of the same were very good. Even after 30,000 revolutions of the drum, there was observed neither operational trouble nor damage.

EXAMPLES 7–13

Employing the following mixtures as substitute for the mixture of linear polyester and isocyanate(ethylene diphenyl isocyanate) used in Example 6, various surface layers were formed and tested in the same manner as in Example 6. All of them exhibited good properties and characteristics equivalent to that of Example 6.

| Example No. | Composition of mixture used (percent by weight) | |
|---|---|---|
| 7. | linear polyester | (92) |
| | methaxylene diisocyanate | (6) |
| | stearic acid amide | (2) |
| 8. | linear polyester | (96) |
| | silane coupling agent (trade name: SH6020*, SH6075** by TORE Silicone Co., Ltd.) | (4) |
| | *$(CH_3O)_3Si(CH_2)_3NHCH_2CH_2NH_2$ | |
| | **$(CH_3COO)_3SiCH{=}CH_2$ | |
| 9. | linear polyester | (95) |
| | transvinylene diisocyanate | (4) |
| | oleic acid amide or calcium stearate | (1) |
| 10. | linear polyester | (94) |
| | 2,4-tolylene diisocyanate | (4) |
| | paraffin wax (m.p. = 85° C.) | (2) |
| 11. | linear polyester | (92) |
| | polyethylene terephthalate | (3) |
| | photosetting acrylic urethane | (5) |
| 12. | linear polyester | (93) |
| | polybutylene terephthalate | (3) |
| | photosetting polyester | (4) |
| 13. | linear polyester | (92) |
| | polyethylene terephthalate | (3) |
| | N-methyl-2-pyrrolidone | (5) |

EXAMPLE 14

A cylindrical aluminum support (200ϕ×500 mm) was dipped in an immersion liquid bath and, after drawing it up from the bath at the rate of 30 mm/min., the drum was subjected to a setting treatment by the irradiation of a 4 KW mercury lamp for five minutes so that a layer 10μ thick was formed. The immersion bath used above was prepared by diluting a photosetting acrylic urethane resin with methyl ethyl ketone to a viscosity of 90 cps.

To the layer thus formed, a second layer 5μ thick was overlaid by repeating the above described dipping operation with only the change that the rate of drawing up was decreased to 23 mm/min. In this manner, a surface layer having the total thickness of 15μ was applied onto the support. This sample is referred to as Sample $D_{16}$.

To another aluminum support with the same size and the same shape as that of Sample $D_{16}$, there was applied at first a layer 10μ thick of acrylic urethane resin in the same manner as above. Secondly, a surface layer 5μ thick was overlaid on the acrylic urethane layer by using an immersion bath prepared by diluting a mixture (96:4) of a linear polyester and an isocyanate (trade name: COLONATE L, by Nippon Polyurethane Co., Ltd.) with methyl ethyl ketone to a viscosity of 90 cps. It was drawn up from the immersion bath at the rate of 23 mm/min. and heated for twenty minutes at 80° C. for setting. The sample thus prepared is referred to as Sample $D_{17}$.

Using each of Samples $D_{16}$ and $D_{17}$ as an electrostatic latent image holding member, a durability test was carried out respectively in the following manner:

Sample was subjected to an electostatic latent image forming process where an electrostatic latent image was formed thereon by applying a corona discharge modulated by passing through an electrostatic latent image formed on a CdS screen photosensitive member. In this process, dry developer charged with positive polarity and a urethane cleaning blade (hardness: 70, blade angle relative to the surface layer of Sample: 30° , and blade pressure: 2.0 Kg) were used, and the durability regarding developing, transferring and cleaning was evaluated.

The results of the test were as follows:

Sample $D_{16}$ showed the coefficient of friction of 2.70 and produced a loud rubbing noise due to the friction between the cleaning blade and the surface layer. After fifty revolutions of the drum, there were already observed a remarkable wear at the blade edge portion and a distinct cleaning damage.

Sample $D_{17}$ showed the coefficient of friction of 1.03 and the drum continued rotating very smoothly with the image on it being maintained good. Even after 40,000 revolutions of the drum there was not observed any wear and tear at the edge portion of the blade. Any film forming due to fusion of developer was found.

Substituting the linear polyesters as specified below for the above described one, further samples, Samples $D_{18}$ and $D_{19}$ were made and tested in the same manner. They exhibited also good durability and cleaning feasibility equivalent to that of Sample $D_{17}$.

Sample $D_{18}$:

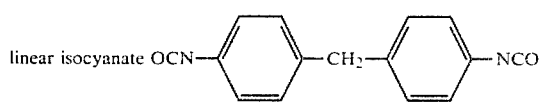

(1)

hexamethylene diol (1)

Sample $D_{19}$:

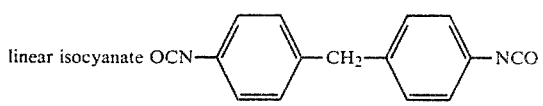

(2)

$HO-(CH_2)_{12}-OH$ (0.8)

silicone oil modified by stearic alcohol (0.1)

The numerical values in the brackets show composition ratio by weight.

Lubricating property of each of the Samples was measured by using a CdS screen photosensitive member in the following manner.

A photoconductive layer of 30μ thick was attached to a stainless steel network (size of opening; about 50μ) by spray coating. The composition of the photoconductive layer was 70 parts by weight of CdS and 30 parts by weight silicone resin (trade name: KR-255, supplied by Shinetsu Silicone Co.), and the resulting photosensitive layer was dried at 80° C. for 15 minutes. Then there was formed an insulating layer of 15μ thick on the photoconductive layer. The insulating layer comprised a silicone resin (trade name: TSR-144, supplied by Toshiba Silicone Co.) containing a curing agent (trade name: CR-15).

A surface of the resulting screen photosensitive member was charged to +450V and subjected to imagewise exposure simultaneously with AC discharging to produce an electrostatic image having −50V at the light portion and +200V at the dark portion. The Samples were placed at the stainless steel wire side of the screen photosensitive member, and corona charging was applied to the Sample through the screen photosensitive member. Then the resulting electrostatic image formed on the sample was developed with a toner and the resulting toner image was transferred to a paper with an impressed voltage for transferring of about −6KV and fixed to produce a visible image.

EXAMPLE 15

On an aluminum drum, a CdS photoconductive layer of 5082 thick was formed, which consisted of 10 parts by weight of vinyl chloride-vinyl acetate copolymer and 90 parts by weight of CdS powder. Further, a layer of 3μ thick of a setting epoxy resin adhesive was applied onto the photoconductive layer and lastly a film 25μ thick of polyethylene terephthalate was overlaid by adhesion on the bonding layer. In this manner, a photosensitive drum was manufactured, which is referred to as photosensitive drum X.

Another photosensitive drum, that is, photosensitive drum Y was manufactured in the same manner as that for the photosensitive drum X, but with the change that instead of polyethylene terephthalate, a layer 25μ thick of linear polyester resin was overlaid by coating on the setting epoxy resin layer.

Under the condition of the moisture of 60% R.H., an electrostatic latent image was formed on each of the photosensitive drums X and Y according to an usual electrophotographic process comprising the steps of a primary charging with negative polarity, a secondary AC discharging simultaneous with imagewise exposure and a whole surface exposure.

The formed electrostatic image on either of photosensitive drums X and Y exhibited a high electrostatic contrast of 750 V (dark image portion ⊕650 V and light image portion ⊖100 V). The toner image obtained by developing the electrostatic latent image with wet toner also exhibited a high sharpness in either case of X and Y.

The next test was carried out after allowing the photosensitive drums X and Y to stand for twenty hours in the atmosphere of 30° C. and 85% relative humidity. An electrostatic image and a toner image were formed on each of the drums X and Y in the same manner as described above.

The electrostatic image formed on the photosensitive drum X showed a lower electrostatic contrast of 410 V (dark image portion: ⊕400 V, light image portion: ⊖10 V) and the toner image also lacked sharpness.

The photosensitive drum Y again could produce a good electrostatic latent image having a high electrostatic contrast of 720 V (dark image portion ⊕630 V, light image portion ⊖90 V). The toner image obtained from the latent image exhibited a high sharpness equal to that of the first test.

EXAMPLE 16

On an aluminum drum, a CdS photconductive layer of 50μ thick was formed, which consisted of 10 parts by weight of vinyl chloride-vinyl acetate copolymer and 90 parts by weight of CdS powder. Further, a layer of 3μ thick of a setting epoxy resin bonding agent was applied onto the photoconductive layer and lastly a film 25μ thick of polypropylene was overlaid by adhesion on the bonding layer. In this manner, a photosensitive drum was manufactured, which is referred as photosensitive drum U.

Another photosensitive drum, that is, photosensitive drum V was manufactured in the same manner as that for the photosensitive drum U, but with the change that instead of polyethylene terephthalate, a layer of 25μ thick of linear polyester resin (trade name: B-301, by Kansai Paint Co., Ltd.) was overlaid by coating on the setting epoxy resin layer.

Under the condition of the moisture of 60% R. H., an electrostatic latent image was formed on each of the photosensitive drums U and V according to an usual electrophotographic process comprising the steps of a primary charging with negative polarity, a secondary AC discharging simultaneous with imagewise exposure and a whole surface exposure.

The formed electrostatic image on either of photosensitive drums U and V exhibited a high electrostatic-contrast of 750 V (dark image portion ⊕650 V and light image portion ⊖ϕV). The toner image obtained by developing the electrostatic latent image with wet toner also exhibited a high sharpness in either case of U and V.

The next test was carried out after allowing the photosensitive drums U and V to stand for 25 hours in the atmosphere of 25° C. and 90% relative humidity. An electrostatic image and a toner image were formed on each of the drums in the same manner as described above.

The electrostatic image formed on the photosensitive drum U showed a lower electrostatic contrast of 340 V (dark image portion ⊕340 V, light image portion 0) and the toner image also lacked sharpness.

The photosensitive drum V again produced a good electrostatic latent image having a high electrostatic contrast of 720 V (dark image portion ⊕630 V, light image portion ⊖90 V). The toner image obtained from the latent image exhibited a high sharpness equal to that of the first test.

EXAMPLE 17

On an aluminum drum, a CdS photoconductive layer 50μ thick was formed, which consisted of 10 parts by weight of vinyl chloride-vinyl acetate copolymer and 90 parts by weight of CdS powder. Further, on the photoconductive layer a film 25μ thick of epoxy resin (trade name: EPIKOTE, by SHELL Chemicals) was overlaid by coating. In this manner, a photosensitive drum was manufactured, which is referred as photosensitive drum S.

Another photosensitive drum, that is, photosensitive drum T was maufactured in the same manner as that for the photosensitive drum S, but with the change that in stead of epoxy resin, a layer 25μ thick of linear polyester resin was overlaid by coating on the photoconductive layer.

Under the condition of the moisture of 60% R.H., an electrostatic latent image was formed on each of the photosensitive drums T and S according to an usual electrophotographic process comprising the steps of a primary charging with negative polarity, a secondary AC discharging simultaneous with imagewise exposure and a whole surface exposure.

The formed electrostatic image on either of photosensitive drums S and T exhibited a high electrostatic contrast of 750 V (dark image portion ⊕ 650 V, and light image portion ⊖ 100 V). The toner image obtained by developing the electrostatic latent image with wet toner also exhibited a high sharpness in either case of S and T.

The next test was carried out after allowing the photosensitive drums S and T to stand for 25 hours in the atmosphere of 30° C. and 85% relative humidity. An electrostatic image and a toner image were formed on each of the drums in the same manner as described above.

The electrostatic image formed on the photosensitive drum S showed a lower electrostatic contrast of 360 V (dark image portion ⊕ 350V, light image portion ⊖ 10V) and the toner image also lacked sharpness.

The photosensitive drum T again could produce a good electrostatic latent image having a high electrostatic contrast of 710V (dark image portion ⊕ 620V, light image portion ⊖ 90V). The toner image obtained from the latent image exhibited a high sharpness equal to that of the first test.

Using the following materials substitute for the linear polyester used in this example, further photosensitive drums P, Q and R were manufactured and tested according to the procedure as described above. All of these drums P, Q and R showed an excellent moisture resisting property equivalent to that of the above described photosensitive drum T.

| Photosensitive Drum | Composition of material used (part by weight) | |
|---|---|---|
| (P) | linear polyester resin | (80) |
| | 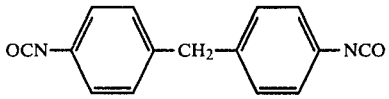 | (10) |
| | hexamethylene diol | (10) |
| (Q) | linear polyester resin (trade name: B-301) | (60) |

-continued

| Photosensitive Drum | Composition of material used (part by weight) | |
|---|---|---|
| | 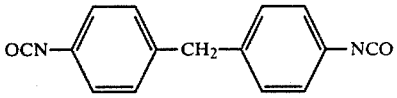 hexamethylene diol | (20) |
| (R) | 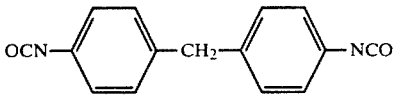 hexamethylene diol | (50) (50) |

We claim:

1. An image holding member for holding electrostatic image and/or toner image, characterized in that the surface of the image holding member has a surface layer, said surface layer essentially consisting of at least one of the substance A and B wherein the substance A represents a linear polyester having a structural unit $+OOC—R—COO—R'+$ in which the dibasic acid compound is:

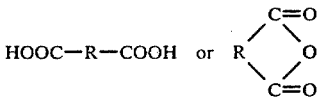

and the diol compound is HO—R'—OH, wherein R and R' are organic groups and are the same or different within each said structural unit, such that each said structural unit is the same or different, said polyester having a molecular weight in the range of 5,000 to 50,000 and is soluble in organic solvent, and the substance B represents a polymerization product of a linear isocyanate compound of the formula:

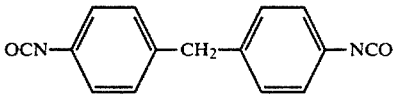

and a polyol compound of the formula:

$HO—(CH)_n—OH$ wherein n is a positive integer from 2 to 20 .

2. An image holding member as claimed in claim 1 wherein said surface layer contains additionally at least one member selected from the group consisting of isocyanates, silane coupling agents, fatty acid amides, fatty acid metal salts and wax.

3. An image holding member as claimed in claim 1 wherein said surface layer further contains any of acrylic resins, urethane resins, acrylic urethane resins and silicone resins.

4. An image holding member as claimed in claim 1 wherein said surface layer has a thickness ranging from 0.1 to 100μ.

5. An image holding member for holding electrostatic image and/or toner image, characterized in that the image holding member comprises a photo conductive layer and a surface layer, said surface layer being on the upper surface of said member and consisting essentially of at least either one of substances A and B wherein the substance A represents a linear polyester having a structural unit $+OOC—R—COO—R'+$ in which the dibasic acid compound is:

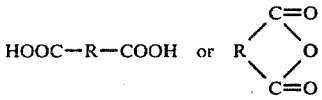

and the diol compound is HO—R'—OH, wherein R and R' are organic groups and are the same or different within each said structural unit, such that each said structural unit is the same or different, said polyester having a molecular weight in the range of 5,000 to 50,000 and is soluble in organic solvent, and the substance B represents a polymerization product of a linear isocyanate compound of the formula:

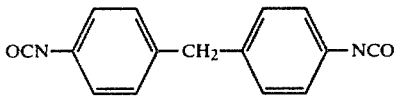

and a polyol compound of the formula:

$HO—(CH_2)_n—OH$ wherein n is a positive integer from 2 to 20.

6. An image holding member as claimed in claim 5 wherein an insulating layer is interposed between said surface layer and said photoconductive layer.

* * * * *